United States Patent [19]

Hara

[11] 4,352,879

[45] Oct. 5, 1982

[54] SELF-PROCESSING TYPE PHOTOGRAPHIC FILM UNIT WITH A TRAP MEMBER HAVING GAS DISCHARGING MEANS

[75] Inventor: Yoshio Hara, Minami-ashigara, Japan

[73] Assignee: Fuji Photo Film Co., Ltd., Kanagawa, Japan

[21] Appl. No.: 210,713

[22] Filed: Nov. 26, 1980

[30] Foreign Application Priority Data

Nov. 29, 1979 [JP] Japan ..... 54/154618

[51] Int. Cl.[3] ..... G03C 1/48; G03D 9/02

[52] U.S. Cl. ..... 430/209; 430/498; 354/304

[58] Field of Search ..... 430/209, 498, 497; 354/304

[56] References Cited

U.S. PATENT DOCUMENTS 3,751,256 8/1973 Harvey ..... 430/498

4,042,396 8/1977 Sylvester ..... 430/209

*Primary Examiner*—John E. Kittle

*Assistant Examiner*—John L. Goodrow

*Attorney, Agent, or Firm*—Sughrue, Mion, Zinn, Macpeak & Seas

[57] ABSTRACT

A self-processing type photographic film unit having an improved trap structure for collecting surplus processing solution used in developing the unit. The trap structure includes a partition member dividing a pouch-shaped hollow interior formed by a trap cover member into upper and lower chambers and forming a U-shaped flow path which communicates with gas discharging through-holes formed in the upper surface of the trap cover member. First and second spacer members are provided on the lower and upper surfaces of the partition member with the first and second spacer members permitting the U-shaped flow path to pass gas in the unit while catching surplus processing solution.

9 Claims, 9 Drawing Figures

SELF-PROCESSING TYPE PHOTOGRAPHIC FILM UNIT WITH A TRAP MEMBER HAVING GAS DISCHARGING MEANS

BACKGROUND OF THE INVENTION

The present invention relates to self-processing type photographic film units. More particularly, the invention relates to an improved self-processing type photographic film unit having a trap structure for collecting at a predetermined position in the unit surplus processing solution used in developing the unit.

The term "self-processing type photographic film unit", hereinafter referred to merely as "a unit" when applicable, as used herein refers to so-called "instant print film" which is manufactured by Polaroid Co. or Eastman Kodak Co. for instance.

There are currently available various types of units employing different layer constructions and developing methods. However, they are alike in their basic construction. A prior art unit, as shown in FIG. 1, includes two main flexible sheets, namely, a first sheet member 11 including an image receiving layer and a second sheet member 12 provided to facilitate in uniformly distributing processing solution to a predetermined thickness. The two sheet members 11 and 12 are bonded together by a bonding member 13, such as an intermediate sheet or tape, in such a manner that the sheet member 12 is above the sheet member 11. When assembled, the two sheets 11 and 12 form a container structure 16 along the front edge of the unit and a trap structure 17 along the rear edge. The container structure 16 holds processing solution. Upon application of external pressure, a predetermined part or parts of the container structure 16 are opened so that the processing solution held therein is spread over a processing liquid spreading region 15 which is defined between the two sheet members 11 and 12. The trap structure 17 operates to catch any surplus of the processing solution thus spread.

To develop the unit 10 after exposure, the entire unit 10 is squeezed beginning with the front edge. Therefore, first the container structure 16 is opened so that the processing solution is discharged into the processing solution spreading region 15 between the sheet members 11 and 12 gradually spreading the pressing solution towards the rear edge of the unit 10.

The processing solution discharged into the processing solution spreading region 15 together with a small quantity of gas from the spreading region 15 is moved towards the rear edge of the unit 10 and surplus processing solution and the gas are pushed into the trap structure. In this way, the spreading of the processing solution is accomplished.

In this operation, it is necessary to discharge the gas which was pushed into the trap structure 17 outside with the movement of the processing liquid; otherwise not only the spreading and movement of the processing liquid would not be effected smoothly but also the gas would remain in the spreading region 15 or would be moved back to the spreading region from the trap structure 17 thus causing an irregularly developed picture.

In order to overcome this difficulty, a variety of techniques have been proposed in the art to improve the gas discharging mechanism of the trap structure 17. In one example of such an improved mechanism, as disclosed in U.S. Pat. Nos. 2,262,460, 3,615,540 and 3,619,193, holes or slits are formed in the trap cover member. These holes or slits are so small that they cannot be visually detected. The holes or slits resist the passage of the viscous processing liquid but permit the passage of the gas.

In another technique, as disclosed in U.S. Pat. No. 3,589,904, the two sheet members are bonded together through the bonding member except for in a small region of the bonding member so that the gas can be discharged through the small region.

In accordance with another technique, as disclosed in U.S. Pat. No. 2,627,460, the rear edge of the film unit is made of a porous material such as a porous polymer film or a fibrous material so as to permit the passage of the gas with minimum resistance and to effectively stop the passage of the viscous processing solution.

Another conventional technique has been disclosed in Japanese Laid-Open Patent Application No. 11027/1977 which, as shown in FIG. 2, provides a trap structure 27 having a gas discharging mechanism. In this conventional trap structure, the rear edge portion of a bonding member 13 which bonds first and second sheet members 11 and 12 together extends past the rear edge of the two sheet members 11 and 12 and is then folded over the upper surface of the second sheet member 12 thereby forming a trap cover member 21 in the form of a pouch having a hollow interior. The trap cover member 21 has a number of gas discharge through-holes 22 in a line formed in the upper surface. The second sheet member 12 has a cut 23 at the rear end portion thereof in the hollow interior of the trap cover member 21. A porous spacer member 24 is provided in the hollow interior with part of the spacer member 24 fitted into the cut 23. A layer 25 for preventing permeation of the processing solution is provided on the upper surface of the spacer member 24 or between the trap cover member 21 and the spacer member 24. With the trap structure 27 thus constructed, the surplus processing solution is caught in the small pores of the porous spacer member 24 and only the gas is allowed to reach the gas discharging holes 22.

However, it has been found that, with the trap structure of the conventional unit described above, it is difficult to completely prevent leakage of the surplus processing solution and to improve the gas permeability, depending on the conditions of use of the camera or the storage conditions of the unit.

The inventor has conducted intensive research and analysis to determine the factors which affect the leakage of surplus processing solution and which cause unsatisfactory gas permeation and, as a result, has found the following:

(1) A cause of surplus processing solution leakage is the increased quantity of surplus processing solution leakage pushed into the trap structure resulting upon increased temperature and humidity or mechanical errors in the camera. Especially when the unit is processed under conditions of a temperature of 40° C. or more and a humidity of 90% RH or more, surplus processing solution tends to leak.

(2) Another cause is that, after the unit has been exposed, the trap structure of the unit can be carelessly pressurized by the user. This problem has been solved to an extent by the provision of a unit according to the above-described Japanese Laid-Open Patent Application No. 11027/1977. However, if this problem co-exists with the problem of paragraph (1), surplus processing solution will still leak.

(3) The cause for the unsatisfactory gas permeability is that the gas flow path in the trap structure can become blocked by undesirable adhesion which occurs between the upper and lower inner walls of the trap cover member or between the inner walls and the surface of the layer which resists passage of the processing solution.

In view of the above-described causes, the inventor has conducted studies and experiments and from them accomplished the present invention.

Accordingly, a first object of the invention is to provide a unit in which all of the above-described difficulties accompanying a conventional unit have been eliminated.

A second object of the invention is to provide a unit in which, without greatly altering the basic arrangement of the conventional unit and utilizing the basic conventional processing system, the processing solution is uniformly spread, surplus processing solution is completely caught, and trapped gas is smoothly and effectively discharged.

SUMMARY OF THE INVENTION

The foregoing objects and other objects of the invention has been achieved by the provision of a self-processing type photographic film unit including a first sheet member, a second sheet member, a bonding member disposed between the first and second sheet members forming an integral unit therewith, container means holding processing solution with the container means being openable under an external pressure to discharge the processing solution into the unit, and trap means for catching surplus processing solution, in which, according to the invention, the trap means includes a partition member which divides a pouch-shaped hollow interior formed by a trap cover member into an upper chamber and a lower chamber and forms a U-shaped flow path which communicates with gas discharging through-holes formed in the upper surface of the trap cover member and first and second spacer members provided on the lower and upper surfaces of the partition member, respectively, the first and second spacer members permitting the U-shaped flow path to pass gas in the unit and to catch the surplus processing solution.

DESCRIPTION OF THE PREFERRED EMBODIMENTS

A preferred embodiment of a unit constructed according to the present invention will be described with reference to FIG. 3. FIG. 3 is a sectional view showing essential components of the unit according to the invention in which those components which have been described with reference to FIGS. 1 and 2 are accordingly similarly numbered.

Figure 1:
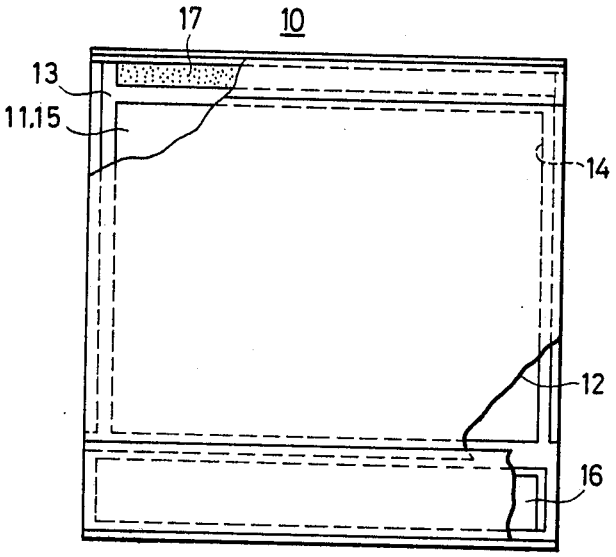
FIG. 1 PRIOR ART
FIG. 1 is a plan view of an example of a conventional film unit.
Figure 2:
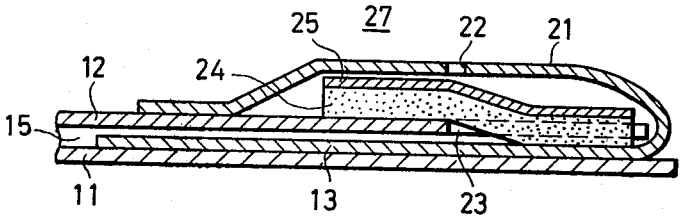
FIG. 2 PRIOR ART
FIG. 2 is a sectional view showing essential components of another example of a conventional film unit.
Figure 3:
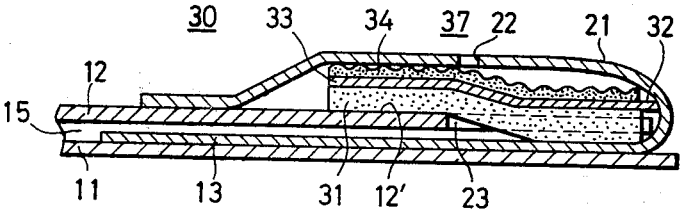
FIG. 3 is a sectional view showing essential components of a preferred embodiment of a film unit according to the invention.

As can be seen from FIG. 3, the unit of the invention differs from the conventional units shown in FIGS. 1 and 2 only in its trap structure. Specifically, the unit of the invention is composed of a first sheet member 11 including an image receiving layer, a second sheet member 12 for controlling the spread of processing liquid to a predetermined thickness, a bonding member 13 such as an intermediate sheet or an adhesive tape which bonds the first and second sheet members 11 and 12 together into a single assembly, and a container structure 16 provided along the front edge of the assembly. The container structure 16 holds the processing solution. Upon application of external pressure the container structure 16 is opened and the processing solution is spread over a processing solution spreading region 15 between the first and second sheet members 11 and 12.

The unit 30 according to the invention has a trap structure 37 which is formed as follows. The rear end portion of the bonding member 13 which bonds the sheet members 11 and 12 together and which if extended linearly outwardly would extend substantially beyond the rear edges of the first and second sheet members 11 and 12, is folded over the upper surface of the second sheet member 12 to form a trap cover member 21 in the shape of a pouch having a hollow interior. The trap cover member 21 resists permeation of the processing solution. The trap cover member has a number of through-holes or gas discharging holes 22 arranged longitudinally therein. The second sheet member 12 has a cut 23 at its rear end portion. A first spacer member 31 is provided in the hollow interior of the trap cover member with a portion thereof fitted into the cut 23. The first spacer member 31 covers that portion of the upper surface 12' of the second sheet member 12 which is adjacent to the cut 23. The first spacer member 31 is made of a flexible material which permits the passage of gas therethrough but prevents the passage or processing solution. A partition member 33 is provided on the first spacer member 31. The rear edge of the partition member 33 is fixedly secured to the inner wall of the bent portion of the trap cover member 21 with a bonding agent 32 such as adhesive so as to stop the surplus processing solution while the free end portion of the partition member 33 is disposed relatively close to the corresponding inner wall of the trap cover member 31 so that the hollow interior of the trap cover member 21 is divided into upper and lower chambers. The partition member 33 is made of a thin and flexible material which resists permeation of the processing solution. A second spacer member 34 is provided between the partition member 33 and the trap cover member 21 in the upper chamber. The second spacer member 34 is also made of a flexible material which permits the passage of gas but not processing solution.

Examples of the material of the first and second spacer members 31 and 34 are sheets of materials such as gauze, lace, unwoven cloth, glass wool, blotter paper, filter paper, felt, and fine-mesh plastic net all of which are flexible and can pass gas but not processing solution.

The area of the first and second spacer members 31 and 34 is substantially equal to that of the partition member 33. The first and second spacer members 31 and 34 are fixedly secured respectively to the lower surface and the upper surface of the partition member 33. Both the upper surface of the second spacer member 34, which confronts the inner wall of the trap cover member 21, and the lower surface of the first spacer member 31, which is always in contact with the aforementioned cut 23 of the second sheet member 12 which is close to the cut 23, are rough. It is preferable that the surface roughness of the upper surface of the second spacer member 34 be equal to or larger than that of the lower surface of the first spacer member in order to prevent the occurrence of unsatisfactory gas discharge conditions due to the above-described undesired adhesion especially around the gas discharging holes 22. The surface roughness is preferably that of cloth, gauze, lace or unwoven cloth. Accordingly, if paper is employed which originally has a relatively smooth surface, the paper should be subjected to a roughening treatment.

The partition member 33 is made of a material which is flexible and which substantially prevents the permeation of surplus processing solution. Examples of suitable materials are plastic films of polyethylene, polyester, polypropylene, cellulose acetate, vinyl chloride or polyamide, paper containing a sizing agent, and waxed paper.

In order to limit the size of the trap structure 37 to not more than that of the trap structure of the conventional unit, it is necessary to minimize the size of the upper chamber in the trap cover member 21 and to increase the volumetric ratio of the lower chamber in which the first spacer member 31 extends into the lower chamber thereby making the amount of surplus processing solution capable of being caught by the first spacer member 31 substantially equal to that of the conventional unit. Accordingly, it is necessary for the second spacer member 34 to have a considerably small thickness.

The operation of the unit thus constructed will be described.

After a photographing operation with the unit, the unit 30 is pressed by an external pressing mechanism including a depressing roller beginning with the container structure 16 and continuing towards the trap structure 37 whereupon first the predetermined portion of the container structure 16 is opened so that the processing solution stored therein is discharged into the processing solution spreading region 15 between the first and second sheet members 11 and 12. As the external pressure application line moves from the container structure 16 toward the trap structure 37, the discharged solution is spread uniformly between the first and second sheets 11 and 12 to a predetermined thickness. Thus, the processing solution together with the gas (mainly air) sealed in the unit when the two sheet members 11 and 12 are bonded together is moved into the trap structure 37.

Of the processing solution spread uniformly in the processing solution spreading region 15, the surplus together with the gas is introduced through the cut 23 into the hollow interior of the trap cover member 21. The surplus processing solution and the gas first enter the first spacer member 31 in the lower chamber of the trap cover member 21 and as a result only the surplus processing solution is caught in the first spacer member 31 while the gas is made to flow along a U-shaped flow path to be discharged through the gas discharging holes 22 in the second spacer member 34 in the upper chamber of the trap cover member 21.

As the quantity of surplus processing solution introduced into the trap structure 37 is gradually increased, the quantity of the surplus processing solution caught in the first spacer member 31 is also gradually increased. Finally, when the quantity of surplus processing solution caught in the first spacer member 31 in the lower chamber of the trap cover member 21 has reached the maximum or limit value, the introduction of surplus processing solution is halted.

In this operation, the gas moves along a U-shaped flow path to be smoothly discharged through the gas discharging holes while the surplus processing solution is caught by the first spacer member 31 inside the lower chamber or in nearby portions of the upper chamber because the partition member 33 does not permit permeation of the processing solution and because the rear edge of the partition member 33 is sealingly connected to the inner wall of the trap cover member 21.

Even at high temperatures or high humidity, because of the provision of the two spacer members 31 and 34 and because the above-described undesired adhesion is never present in the U-shaped flow path, the gas can flow satisfactorily while the processing solution is also caught satisfactorily. Moreover, the gas cannot flow in the reverse direction. As a result, the formation of irregular images is prevented at all times.

If the user carelessly depresses the upper surface of the trap cover member 21, a part of the surplus processing solution caught by the first spacer member 31 may be made to flow along the U-shaped flow path towards the second spacer member 34 in the upper chamber of the trap cover member 21. However, in this case, since part of the surplus processing solution is caught by the second spacer member 34, surplus processing solution will not leak through the gas discharging holes 22.

In the presence of a high temperature and high humidity, the volume of the surplus processing solution may increase to the extent that all of the surplus processing solution cannot be caught by the first spacer member 31. In this case also, the surplus processing solution will not be leaked because the surplus processing solution which is not caught by the first spacer member 31 will be caught by the second spacer member 34.

Figure 4:
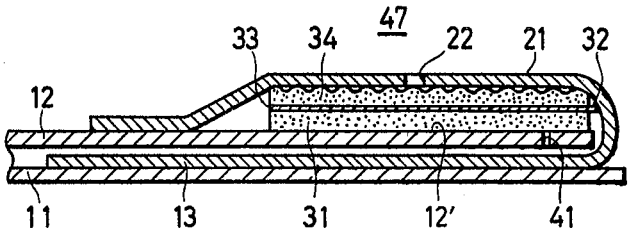
FIGS. 4 and 5 are sectional views showing essential components of alternative embodiments of a film unit according to the invention.

FIG. 4 shows an alternative embodiment of the trap structure of the unit according to the invention. The trap structure 47 of FIG. 4 differs from that of FIG. 3 only in its arrangement of the second sheet member 12 and the first spacer member 31. The upper surface of the rear end portion of the second sheet member 12 is covered by the entire lower surface of the first spacer member 31. A small slit or hole 41 is formed in the rear end portion of the second sheet member 12 so that surplus processing solution and gas can reach the lower surface of the first spacer 31 through the small slit or hole 41. This embodiment eliminates the steps of forming a cut in the rear end portion of the second sheet member 12 and of positioning the first spacer member 31 which are involved in the manufacture of the unit of FIG. 3.

The processing solution and the gas can be made to more smoothly go through the slit or hole 41 by employing the following technique. That is, if the rear end portion of the first spacer member 31 is made shorter so that there is a space provided above the slit or hole 41, the solution and the gas can pass through the slit or hole 41 more readily.

Figure 5:
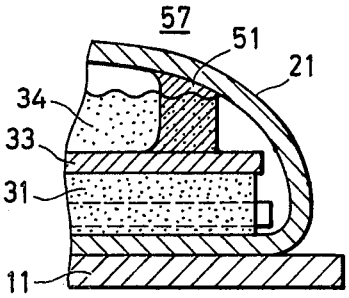

FIG. 5 is a sectional view of another alternative embodiment of the trap structure in the unit according to the invention. The trap structure 57 shown in FIG. 5 is obtained by modifying the way in which the rear edge of the partition member 33 is secured to the inner wall of the trap cover member 21. In this embodiment, the rear edge of the partition member 33 is not secured directly to the inner wall of the trap cover member 21 but instead the rear edge of the second spacer member 34 is fixedly bonded to the inner wall of the trap cover member 21 such as with an adhesive 51. The adhesive 51 is applied in such a manner that, after it has sufficiently permeated the second spacer member 34, a part of the adhesive 51 reaches the upper surface of the partition member 33 whereby the partition member 33 is indirectly coupled to the inner wall. This embodiment has an advantage that the work necessary for attaching the partition member 33 is improved in efficiency.

In the above-described embodiments, the spacer members 31 and 34 are attached respectively to the lower surface and the upper surface of the partition member 33. However, substantially the same effect can be obtained merely by inserting the spacer members 31 and 34 in the lower chamber and the upper chamber of the trap cover member 21, respectively.

Furthermore, in the above-described embodiments, the trap cover member 21 is described as being formed by extending the bonding member 13 such as with an intermediate sheet. However, the trap cover member 21 may be constructed by using a member separated from the intermediate sheet or by extending and folding the rear end portion of the bonding member into which the sheet members 11 and 12 are inserted to form a single unit in which the second sheet member 12 is placed over the first sheet member 11.

The unit of the invention described above has the following novel effects and advantage:

(1) The hollow interior of the trap cover member 21 is divided into upper and lower chambers by a flexible and thin partition member through which the processing solution cannot flow to thereby form a U-shaped flow path. Therefore, the surplus processing solution introduced into the hollow interior is stably held in the lower chamber while preventing it from flowing directly to the gas discharging holes 22.

(2) The hollow interior of the trap cover member 21 is divided by the partition member 33 into upper and lower chambers to form a U-shaped flow path as described above and the two spacer members 31 and 34 are inserted into the respective chambers. Accordingly, even at high temperatures and high humidity, the occurrence of undesired adhesion never occurs in the hollow interior and accordingly surplus processing solution is satisfactorily caught while the gas flows satisfactorily.

(3) Even if the upper surface of the trap cover member 21 is depressed carelessly by the user, surplus processing solution will not leak because the second spacer member 34 can sufficiently catch the processing solution.

An actual example of a unit of the invention and a comparison example will be described in order to clarify the novel effects and advantages of the invention.

COMPARISON EXAMPLE

Unit specimens were manufactured according to the FIG. 3 embodiment of the specification of Japanese Laid-Open Patent Application No. 11027/1977.

Dimensions of essential components:

| | | |
|---|---|---|
| Trap Structure | 1 | Volume of the hollow interior of the trap cover member . . . 0.35 cc |
| | 2 | Spacer element . . . Nylon woven cloth (210D, mesh 12 × 8.5) |
| | 3 | Non-permeable layer . . . Polyethylene of thickness 25μ |

The leakage of surplus processing solution and gas permeability of the trap structure were monitored under the following conditions:

(1) Surplus processing solution leakage

Unit specimens having surplus processing solution capacities of 0.185 cc at 20° C. and 0.250 cc at 20° C., respectively, were held at temperature and humidity conditions of 5° C./40% RH, 20° C./65% RH, 40° C./30% RH and 40° C./90% RH for one hour. Thereafter, immediately after the unit specimens were developed in an atmosphere of 20° C./65% RH, loads of 0 g, 500 g and 2000 g were applied to the upper surfaces of the trap structures. Then, it was visually determined whether or not the surplus processing solutions leaked through the gas discharging holes. With respect to this visual determination, it has been confirmed in preliminary experiments that quantities of solution leakage of the order of 0.001 to 0.005 cc can be positively detected.

(2) Gas permeability

Unit specimens having surplus processing solution capacities 0.185 cc at 20° C. were held at temperature and humidity conditions of 20° C./65% RH/3 days and 40° C./80% RH/3 days. Thereafter, immediately after they were developed in an atmosphere of 20° C./65% RH, the unit specimens were tested for gas discharging quantity and air reverse flow as follows:

(a) Gas discharging quantity

The total quantity (cc/min) of air discharged through the gas discharging holes of the trap structure was measured while air was injected so that the processing solution spreading region had a pressure of +150 mm $H_2O$.

(b) Air reverse flow

After being developed, the units were visually examined to determine whether or not the entire image forming area of each unit had irregularly processed portions.

The measurement and determination results for the Comparison Example are shown in Table I and Table II.

UNIT OF THE INVENTION

Unit specimens were manufactured which were the same as those in the above-described Comparison Example except that the trap structures were constructed in accordance with the invention.

These unit specimens were tested for leakage of surplus processing solution and gas permeability under the same conditions as those used for the above-described Comparison Example.

Dimensions of essential components:

| | |
|---|---|
| Trap Structure | 1 Volume of the hollow interior of the trap cover member . . . 0.35 cc<br>2 Volume of the upper and lower chambers of the trap cover member . . . 0.25 cc<br>3 First spacer member . . . Nylon woven cloth (210D, mesh 12 × 8.5)<br>4 Partition member . . . Polyethylene of thickness 25μ<br>5 Second spacer member . . . Tetron woven cloth (50D, mesh 19 × 16) |

The two spacer members were bonded to the upper and lower surfaces of the partition member with adhesive and the rear edge of the partition member was also sealingly bonded to the inner wall of the bent portion of the trap cover member.

The test results for the Unit of the Invention are indicated in Table I and Table II.

As is apparent from Table I, the film units of the invention have much less leakage of surplus processing solution than the conventional film units.

Figure 6:
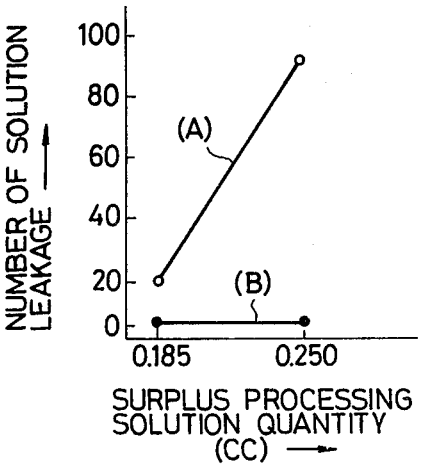
FIG. 6 is a graphical representation indicating surplus processing solution quantity with respect to number of surplus processing solution leakage.
Figure 7:
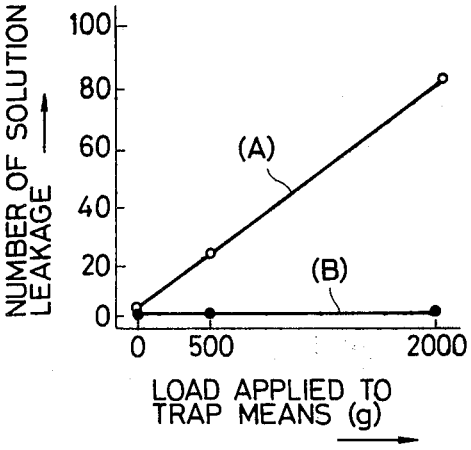
FIG. 7 is a graphical representation indicating load applied to trap structure with respect to number of surplus processing solution leakage.
Figure 8:
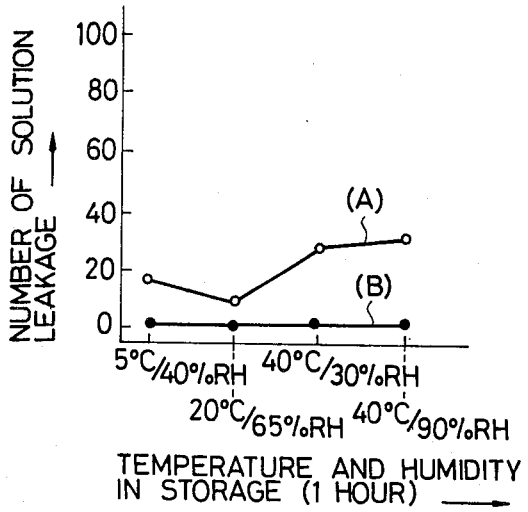
FIG. 8 is a graphical representation indicating temperature and humidity during storage with respect to number of surplus processing solution leakage.

The relative effects of the surplus processing solution quantity, the loads applied to the trap structure and the temperature and humidity conditions during storage can be analyzed from the test results in Table I and the analysis results are indicated in FIGS. 6 through 8. FIG. 6 is a graphical representation indicating surplus processing solution quantity with respect to solution leakage. FIG. 7 is a graphical representation indicating load on the trap structure with respect to solution leakage. FIG. 8 is a graphical representation indicating temperature and humidity during storage with respect to solution leakage.

It can be seen from an inspection of FIGS. 6 through 8 that, as the quantity of surplus processing solution and the load applied to the trap structure are increased, the number of conventional film units (indicated by (A) in the figures) from which the processing solutions leak is increased and that there is a tendency in the conventional film units for surplus processing solution to increasingly leak therefrom as the temperature and humidity increase.

As is clear from Table II, the film units of the invention have much more excellent gas permeability properties than the conventional film units.

Figure 9:
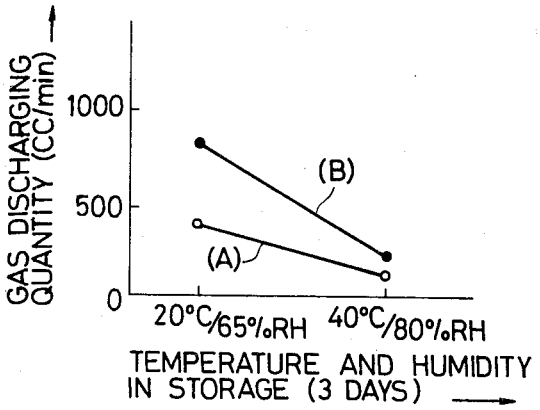
FIG. 9 is also a graphical representation indicating temperature and humidity during storage with respect to gas discharging quantity.

The relationships between the gas discharging quantities and the temperature and humidity conditions during storage have been analyzed from the results in Table II and are shown graphically in FIG. 9. It can be seen from an examination of FIG. 9 that in both the film unit of the invention and the conventional film unit, the gas discharging quantity has a tendency to decrease as the temperature and humidity increase. Also, it may be seen that the conventional film units have a generally smaller gas discharging quantity than the film units of the invention.

TABLE II

| | Gas Permeability Test Results | | | |
|---|---|---|---|---|
| | Comparison Example Temperature and humidity conditions during storage | | Unit of the Invention Temperature and humidity conditions during storage | |
| | 20° C./ 65% RH | 40° C./ 80% RH | 20° C./ 65% RH | 40° C./ 80% RH |
| Gas discharging quantity (cc/min.) | 490.2 | 147.4 | 858.2 | 249.0 |
| Air reverse flow phenomena | 0 | 14 | 0 | 0 |

NOTE:
The lower line in Table is the number of units in which air reverse flow phenomena occured among twenty units which were tested under the same conditions.

What is claimed is:

1. A self-processing type photographic film unit comprising: a first sheet member; a second sheet member; a bonding member disposed between said first and second sheet members and forming a single unit therewith; container means for holding processing solution, said container means being openable under an external pressure to discharge said processing solution into said unit; and trap means for catching surplus processing solution, said trap means comprising:

a trap cover member;

a partition member dividing a pouch-shaped hollow interior formed by said trap cover member into an upper chamber and a lower chamber and forming a U-shaped flow path which communicates with gas discharging through-holes formed in the upper surface of said trap cover member; and first and second spacer members provided adjacent the lower and upper surfaces of said partition member, said first spacer member disposed in said lower chamber and said second spacer member disposed in said upper chamber, said first and second spacer members permitting said U-shaped flow path to pass gas in said unit and retaining surplus processing solution.

2. The unit as claimed in claim 1 wherein said partition member comprises a flexible synthetic resin film which resists passage of said processing solution and a rear portion of said partition member being fixedly secured to the inner wall of said trap cover member so as to substantially resist the passage of surplus processing solution.

3. The unit as claimed in claim 1 wherein said first and second spacer members are fixedly secured to the lower and upper surfaces of said partition member, respectively.

4. The unit as claimed in claim 1 wherein at least the upper surface of said second spacer is rough so that said

TABLE I

| Surplus procession solution quantity (cc) | Trap load (g) | Surplus Processing Solution Leakage Test Results: Comparison Example Temperature and humidity conditions during storage | | | | Unit of the Invention Temperature and humidity conditions during storage | | | |
|---|---|---|---|---|---|---|---|---|---|
| | | 5° C./ 40% RH | 20° C./ 65% RH | 40° C./ 30% RH | 40° C./ 90% RH | 5° C./ 40% RH | 20° C./ 65% RH | 40° C./ 30% RH | 40° C./ 90% RH |
| | 0 | 0 | 0 | 0 | 0 | 0 | 0 | 0 | 0 |
| 0.185 | 500 | 2 | 0 | 1 | 1 | 0 | 0 | 0 | 0 |
| | 2000 | 4 | 0 | 3 | 9 | 0 | 0 | 0 | 0 |
| | 0 | 0 | 0 | 2 | 1 | 0 | 0 | 0 | 0 |
| 0.250 | 500 | 4 | 1 | 10 | 9 | 0 | 0 | 0 | 0 |
| | 2000 | 12 | 14 | 20 | 19 | 0 | 0 | 0 | 0 |

NOTE:
The numbers listed in the Table are the number of unit specimens from which the processing solutions leaked among twenty unit specimens which were tested under the same conditions.

upper surface of said second spacer is partially in contact with the inner wall of said trap cover member.

5. The unit as claimed in claim 1 wherein said first and second spacer members comprise a material selected from the group consisting of gauze, lace, unwoven cloth, glass wool, blotter paper, filter paper, felt and fine-mesh plastic net.

6. The unit as claimed in claim 1 wherein the surface roughness of the upper surface of said second spacer member is at least as great as that of the lower surface of said first spacer member.

7. The unit as claimed in claim 1 wherein said partition member comprises a sheet of material selected from the group consisting of plastic films of polyethylene, polyester, polypropylene, cellulose acetate, vinyl chloride, and polyamide; paper containing a sizing agent; and waxed paper.

8. The unit as claimed in claim 1 wherein the upper surface of a rear end portion of said second sheet or member is covered by the entire lower surface of said first spacer member and wherein an aperture is provided in said rear end portion of said second sheet member.

9. The unit as claimed in claim 1 wherein the rear edge of said second spacer member is bonded to both the inner wall of said trap cover member and the upper surface of said partition member.

* * * * *